US009759387B2

(12) United States Patent
Progl et al.

(10) Patent No.: US 9,759,387 B2
(45) Date of Patent: Sep. 12, 2017

(54) DUAL OPTICAL INTERFACE LED LAMP

(71) Applicant: Cree, Inc., Durham, NC (US)

(72) Inventors: Curt Progl, Raleigh, NC (US); Praneet Athalye, Morrisville, NC (US)

(73) Assignee: Cree, Inc., Durham, NC (US)

( * ) Notice: Subject to any disclaimer, the term of this patent is extended or adjusted under 35 U.S.C. 154(b) by 29 days.

(21) Appl. No.: 14/196,352

(22) Filed: Mar. 4, 2014

(65) Prior Publication Data

US 2015/0252953 A1 Sep. 10, 2015

(51) Int. Cl.

| | |
|---|---|
| ***F21K 9/238*** | (2016.01) |
| ***F21K 99/00*** | (2016.01) |
| ***F21K 9/23*** | (2016.01) |
| *F21V 3/00* | (2015.01) |
| *F21V 23/00* | (2015.01) |
| *F21K 9/62* | (2016.01) |
| *F21K 9/64* | (2016.01) |
| *F21Y 115/10* | (2016.01) |
| *F21Y 107/30* | (2016.01) |

(52) U.S. Cl.

CPC ..... *F21K 9/135* (2013.01); *F21K 9/23* (2016.08); *F21K 9/238* (2016.08); *F21K 9/62* (2016.08); *F21K 9/64* (2016.08); *F21V 3/00* (2013.01); *F21V 23/006* (2013.01); *F21Y 2107/30* (2016.08); *F21Y 2115/10* (2016.08)

(58) Field of Classification Search

CPC .... F21V 23/004–23/006; F21V 23/009; F21V 23/06; F21V 3/00; F21V 3/0418; F21V 3/0492; F21V 19/003; F21K 9/23; F21K 9/232; F21K 9/238; F21K 9/64; F21K 9/66

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |

(Continued)

FOREIGN PATENT DOCUMENTS

| | | | | |
|---|---|---|---|---|
| CN | 103047625 | A * | 4/2013 | ..... F21V 23/00 |
| EP | 1058221 | A2 | 12/2000 | |

(Continued)

OTHER PUBLICATIONS

Machine translation of CN 103047625 A, retrieved from espacenet.com on Jun. 27, 2016.*

*Primary Examiner* — Anh Mai

*Assistant Examiner* — Steven Horikoshi

(74) *Attorney, Agent, or Firm* — Dennis J. Williamson; Moore & Van Allen PLLC

(57) ABSTRACT

A LED lamp includes an at least partially optically transmissive enclosure and a base connected to the enclosure. A plurality of LEDs are located in the enclosure and are operable to emit light when energized through an electrical path from the base. An optical interface is positioned in the enclosure for electrically isolating a live electrical component and for receiving at least a portion of the light. The optical interface includes a light modifying property for modifying a characteristic of the portion of the light.

17 Claims, 12 Drawing Sheets

(56) References Cited

U.S. PATENT DOCUMENTS 5,806,965 A 9/1998 Deese
5,947,588 A 9/1999 Huang
5,949,347 A 9/1999 Wu
6,220,722 B1 4/2001 Begemann
6,227,679 B1 5/2001 Zhang et al.
6,234,648 B1 5/2001 Borner et al.
6,250,774 B1 6/2001 Begemann et al.
6,276,822 B1 8/2001 Bedrosian et al.
6,465,961 B1 10/2002 Cao
6,523,978 B1 2/2003 Huang
6,550,953 B1 4/2003 Ichikawa et al.
6,634,770 B2 10/2003 Cao
6,659,632 B2 12/2003 Chen
6,709,132 B2 3/2004 Ishibashi
6,803,607 B1 10/2004 Chan et al.
6,848,819 B1 2/2005 Arndt et al.
6,864,513 B2 3/2005 Lin et al.
6,948,829 B2 9/2005 Verdes et al.
6,982,518 B2 1/2006 Chou et al.
7,048,412 B2 5/2006 Martin et al.
7,080,924 B2 7/2006 Tseng et al.
7,086,756 B2 8/2006 Maxik
7,086,767 B2 8/2006 Sidwell et al.
7,144,135 B2 12/2006 Martin et al.
7,165,866 B2 1/2007 Li
7,172,314 B2 2/2007 Currie et al.
7,354,174 B1 4/2008 Yan
7,396,142 B2 7/2008 Laizure, Jr. et al.
7,600,882 B1 10/2009 Morejon et al.
7,726,836 B2 6/2010 Chen
7,824,065 B2 11/2010 Maxik
7,965,023 B1 6/2011 Liang
8,021,025 B2 9/2011 Lee
8,253,316 B2 8/2012 Sun et al.
8,272,762 B2 9/2012 Maxik et al.
8,274,241 B2 9/2012 Guest et al.
8,277,082 B2 10/2012 Dassanayake et al.
8,282,249 B2 10/2012 Liang et al.
8,282,250 B1 10/2012 Dassanayake et al.
8,292,468 B2 10/2012 Narendran et al.
8,322,896 B2 12/2012 Falicoff et al.
8,371,722 B2 2/2013 Carroll
8,400,051 B2 3/2013 Hakata et al.
8,415,865 B2 4/2013 Liang et al.
8,421,320 B2 4/2013 Chuang
8,421,321 B2 4/2013 Chuang
8,421,322 B2 4/2013 Carroll et al.
8,427,037 B2 4/2013 Liang et al.
8,449,154 B2 5/2013 Uemoto et al.
8,502,468 B2 8/2013 Li et al.
8,556,465 B2 10/2013 Lee et al.
8,641,237 B2 2/2014 Chuang
8,653,723 B2 2/2014 Cao et al.
8,696,168 B2 4/2014 Li et al.
8,740,415 B2 6/2014 Wheelock
8,750,671 B1 6/2014 Kelly et al.
8,752,984 B2 6/2014 Lenk et al.
8,760,042 B2 6/2014 Sakai et al.
2004/0201990 A1 10/2004 Meyer
2006/0097245 A1* 5/2006 Aanegola ..... H01L 25/0753 257/26
2008/0024067 A1* 1/2008 Ishibashi ..... 315/112
2009/0175041 A1* 7/2009 Yuen ..... F21K 9/135 362/294
2009/0184618 A1 7/2009 Hakata et al.
2011/0176316 A1* 7/2011 Phipps et al. ..... 362/373
2011/0215699 A1* 9/2011 Le ..... F21V 3/00 313/46
2011/0216523 A1* 9/2011 Tong et al. ..... 362/84
2011/0273102 A1 11/2011 Van De Ven et al.
2012/0040585 A1 2/2012 Huang
2012/0134133 A1* 5/2012 Kang ..... F21K 9/135 362/84
2012/0155061 A1* 6/2012 Manabe et al. ..... 362/84
2013/0026923 A1 1/2013 Athalye et al.
2013/0026925 A1 1/2013 Ven et al.
2013/0069535 A1 3/2013 Athalye
2013/0069547 A1 3/2013 Van De Ven et al.
2013/0127353 A1 5/2013 Athalye et al.
2013/0162149 A1 6/2013 Van De Ven et al.
2013/0162153 A1 6/2013 Van De Ven et al.
2013/0169159 A1 7/2013 Lys
2013/0170199 A1 7/2013 Athalye
2013/0214676 A1* 8/2013 Li et al. ..... 313/512
2013/0293135 A1 11/2013 Hu et al.

FOREIGN PATENT DOCUMENTS

EP 0890059 B1 6/2004
GB 2345954 A 7/2000
JP H09265807 A 10/1997
JP 2000173304 A 6/2000
JP 2001118403 A 4/2001
JP 2007059930 A 3/2007
JP 2008288183 A 11/2008
JP 2009117346 A 5/2009
JP 3153766 U 9/2009
JP 2009277586 A 11/2009
WO 0124583 A1 4/2001
WO 0160119 A2 8/2001
WO 2012011279 A1 1/2012
WO 2012031533 A1 3/2012

* cited by examiner

DUAL OPTICAL INTERFACE LED LAMP

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and/or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperatures.

SUMMARY OF THE INVENTION

In some embodiments, a lamp comprises an at least partially optically transmissive enclosure and a base. At least one LED is mounted in the enclosure and is operable to emit light when energized through an electrical path from the base. An optical interface is disposed between the at least one LED and the enclosure such that light from the at least one LED passes through the optical interface. The optical interface is electrically insulating and is configured to electrically isolate at least a portion of the electrical path. The optical interface comprises a light modifying property such that a characteristic of the light may be modified as the light passes through the optical interface.

The characteristic of the light may comprise a color of the light. The optical interface may comprise a phosphor. The optical interface may comprise a REE. The REE comprises neodymium. The electrical path may comprise a live electrical component in the enclosure and the optical interface may electrically isolate the live electrical component. A passage may be provided in the optical interface. The passage may allow a gas to circulate between the at least one LED and the enclosure. The light may comprise a second characteristic and the optical interface may comprise a second light modifying property where the optical interface modifies the first and second characteristics. The light passing through the optical interface may be filtered so that the light exiting the optical element exhibits a spectral notch. The spectral notch may occur between the wavelengths of 520 nm and 605 nm. The base may comprise an Edison screw. The optical interface may comprise an elastic material. The optical interface may comprise silicone.

In some embodiments a lamp comprises an at least partially optically transmissive enclosure and a base connected to the enclosure; A plurality of LEDs are located in the enclosure and are operable to emit light when energized through an electrical path from the base. An optical interface is positioned in the enclosure for electrically isolating a live electrical component and for receiving at least a portion of the light. The optical interface is shatter resistant and comprises a light modifying property for modifying a characteristic of the portion of the light.

In some embodiments a lamp comprises an at least partially optically transmissive enclosure and a base connected to the enclosure. A plurality of LEDs are located in the enclosure and are operable to emit light when energized through an electrical path from the base. An optical interface is positioned in the enclosure for electrically isolating a live electrical component and for receiving at least a portion of the light, the optical interface being made of an elastic material.

DETAILED DESCRIPTION

Figure 1:
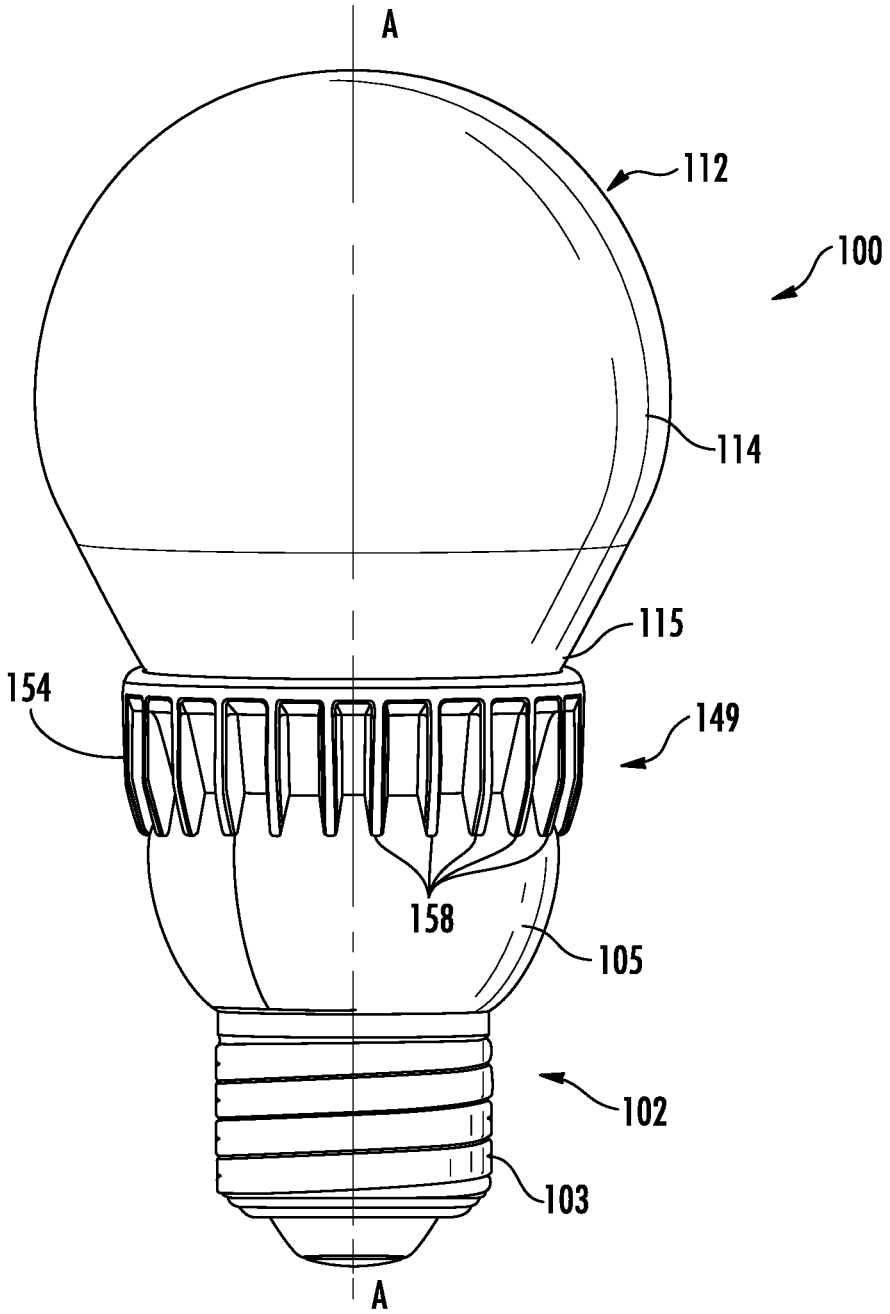
FIG. 1 is a front view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white or near white). In certain embodiments, the aggregated output of multiple solid-state light emitters and/or lumiphoric materials may generate warm white light output having a color temperature range of from about 2200K to about 6000K.

Embodiments of the present invention provide a solid-state lamp with centralized light emitters, more specifically, LEDs. Multiple LEDs can be used together, forming an LED array. The LEDs can be mounted on or fixed within the lamp in various ways. In at least some example embodiments, a submount is used. The LEDs may be disposed at or near the center of the enclosure of the lamp. Since the LED array may be configured in some embodiments to reside centrally within the structural enclosure of the lamp, a lamp can be constructed so that the light pattern is not adversely affected by the presence of a heat sink and/or mounting hardware, or by having to locate the LEDs close to the base of the lamp. It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture for mounting on walls, in or on ceilings, on posts, and/or on vehicles.

Figure 2:
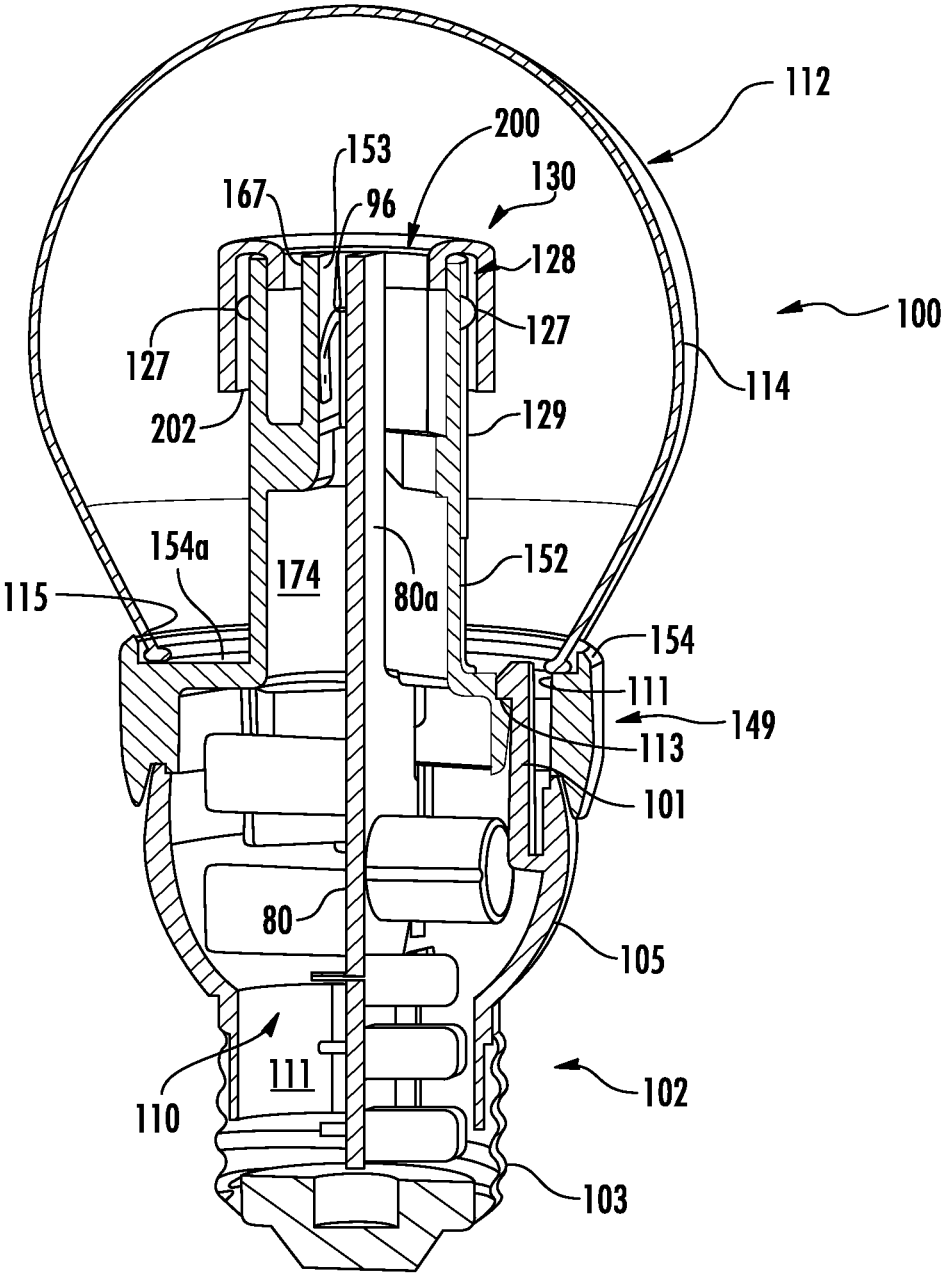
FIG. 2 is a vertical section view of the lamp of FIG. 1.
Figure 3:
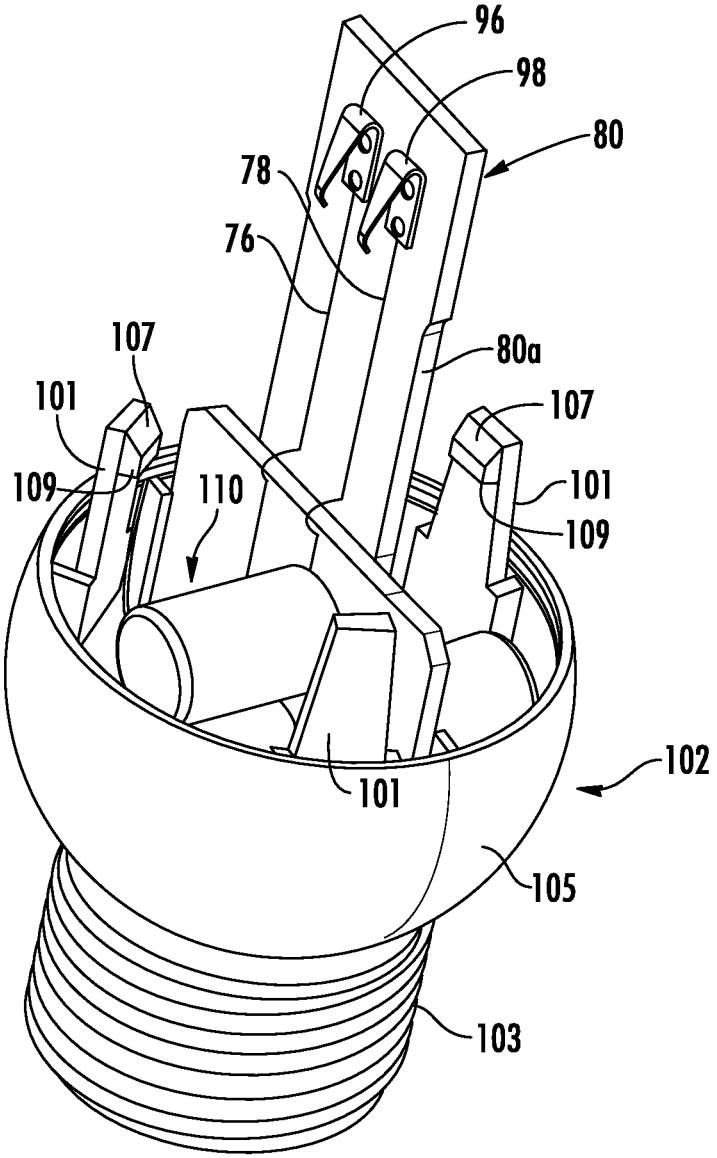
FIG. 3 is a perspective view of the base and lamp electronics of the lamp of FIG. 1.
Figure 13:
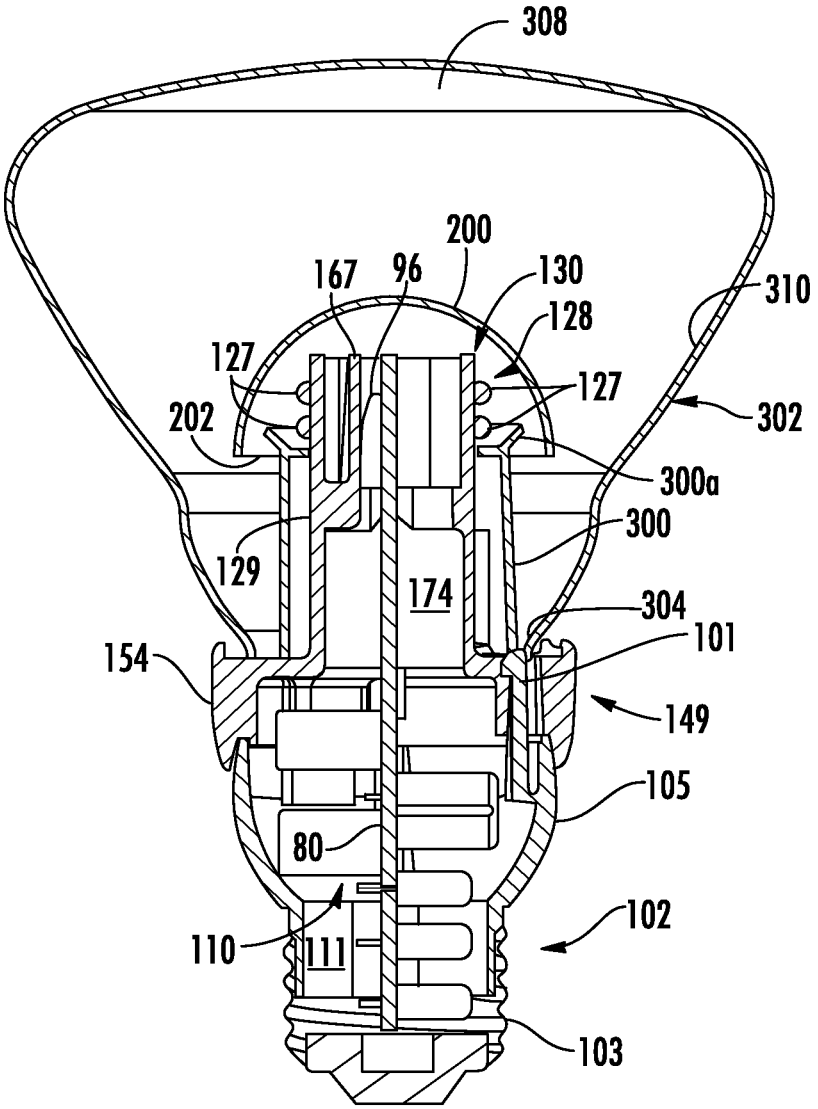
FIG. 13 is a section view similar to FIG. 2 of another embodiment of the lamp of the invention.
Figure 14:
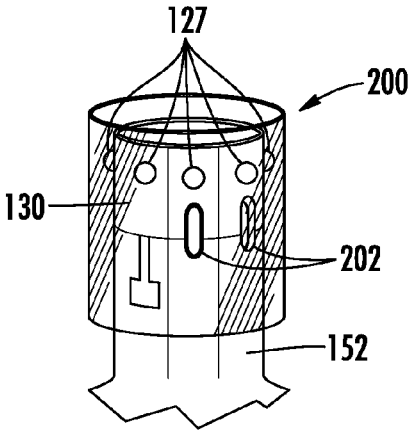
FIG. 14 is a perspective view illustrating an embodiment of an optical interface mounted over an LED assembly.

FIGS. 1 and 2 show a lamp, 100, according to some embodiments of the present invention. In some embodiments the form factor of the lamp is configured to fit within the existing standard for a lamp. Moreover, in some embodiments the size, shape and form of the LED lamp may be similar to the size, shape and form of traditional incandescent bulbs. Users have become accustomed to incandescent bulbs having particular shapes and sizes such that lamps that do not conform to traditional forms may not be as commercially acceptable. Lamp 100 may be used as an A-series lamp with an Edison base 102, more particularly; lamp 100 is designed to serve as a solid-state replacement for an A series lamp such as an A19, A21, A23 or similar incandescent bulb such that the dimensions of the lamp 100 fall within the ANSI standards for such a bulb. The dimensions may be different for other ANSI standard replacement lamps and/or for non-standard lamps. While a lamp having the size and form factor of a standard-sized household incandescent bulb is shown, the lamp may have other the sizes and form factors. For example, the lamp may be a directional lamp such as a replacement for a PAR-style incandescent bulb such as a PAR-38 incandescent bulb or a BR-style incandescent bulb, an embodiment of which is shown in FIG. 13. The lamp may also be embodied in other standard and non-standard form factors and can have any shape, including standard and non-standard shapes. The LED lamp of the invention is designed to provide desired performance characteristics while having the size, shape and form of a traditional incandescent bulb.

The Edison base 102 as shown and described herein may be implemented through the use of an Edison connector 103 and a housing 105. The LEDs 127 in the LED assembly 130 may comprise an LED die disposed in an encapsulant such as silicone. The LEDs 127 may be mounted on a submount 129 to form an LED array 128 and are operable to emit light when energized through an electrical connection. In the present invention the term "submount" is used to refer to the support structure that supports and provides a part of the electrical path to the individual LEDs or LED packages.

Enclosure 112 is, in some embodiments, made of glass, quartz, borosilicate, silicate, polycarbonate, other plastic or other suitable material. The enclosure may be of similar shape to that commonly used in household incandescent bulbs. The enclosure 112 is at least partially optically transmissive such that light generated by LEDs 127 may be emitted through the enclosure 112. In a replacement lamp for a standard A-series incandescent bulb the entire enclosure 112 may be optically transmissive. In some embodiments, a glass enclosure is coated on the inside with silica, providing a diffuse scattering layer that produces a more uniform far field pattern. The enclosure may also be etched, frosted or coated to provide a diffuse scattering layer. Alternatively, the surface treatment may be omitted and a clear enclosure may be provided. The enclosure 112 may have a traditional bulb shape having a globe shaped main body 114 that tapers to a narrower neck 115 where the neck defines an opening into the enclosure 112.

Under some circumstances safety standards require that a person must be electrically isolated from live electrical components that may be in the interior of the enclosure 112 in the event the enclosure breaks. Underwriters Laboratories Inc. (UL) sets forth a standard for safety for self-ballasted lamps and lamp adapters (UL 1993) including a drop test standard that requires that live electrical components in a LED lamp are isolated from a user. The lamp is dropped from a predetermined height and the enclosure surrounding the live electrical components in the lamp must prevent exposure to the live electrical components. A probe is used that simulates a human finger. The probe must be unable to contact the live components.

In some embodiments the enclosure 112 may be made of a shatter proof or shatter resistant material (hereinafter referred to as shatter resistant) that prevents the enclosure from shattering when subjected to the safety tests. In other embodiments the enclosure may be provided with a shatter resistant coating such as a silicone coating. In either event the provision of a shatter resistant enclosure may increase the cost of manufacture of a lamp. Shatter resistant materials such as quartz tend to be more expensive than glass. The application of a shatter resistant coating also adds cost to the manufacture of the lamp and can also be a lengthy and cumbersome manufacturing process that may inhibit higher production capabilities. The coating in some embodiments may also provide a look and feel that is different than a traditional incandescent bulb. The lamp of the invention as described herein may eliminate the use of an external shatter resistant enclosure to provide a lamp with a traditional appearance and feel at lower cost and easier manufacture that provides the desired electrical isolation.

In some embodiments of LED lamps, depending on the LEDs used, the enclosure may be made of glass comprising one or more rare earth element (REE) compounds, such as neodymium, or have a coating comprising one or REE compounds deposited on an interior and/or exterior surface of the glass. The neodymium in the glass may be used to filter out yellow light, resulting in a whiter light emitted from the lamp. While neodymium provides improved light color in some applications, it is relatively expensive such that providing neodymium on the entire enclosure 112 is expensive. The lamp of the invention may be used to provide the optical advantages of REE compounds at lower cost and easier manufacturability.

A lamp base 102 such as an Edison base functions as the electrical connector to connect the lamp 100 to an electrical socket or other connector. Depending on the embodiment, other base configurations are possible to make the electrical connection such as other standard bases or non-standard bases. Base 102 may include the electronics 110 for powering lamp 100 and may include a power supply, including large capacitor and EMI components that are across the input AC line, and/or driver and form all or a portion of the electrical path between the mains and the LEDs. The lamp electronics may be mounted on a board such as printed circuit board (PCB) 80. Base 102 may also include only part of the power supply circuitry while some smaller components reside on the submount 129. With the embodiment of FIG. 1, as with many other embodiments of the invention, the term "electrical path" can be used to refer to the entire electrical path to the LEDs 127, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LED array. Electrical conductors run between the LED assembly 130 and the lamp base 102 to carry both sides of the supply to provide critical current to the LEDs 127 as will be described.

In some embodiments, a driver and/or power supply are included with the LED array 128 on the submount 129. In other embodiments the driver and/or power supply are included in the base 102 as shown. The power supply and drivers may also be mounted separately where components of the power supply are mounted in the base 102 and the driver is mounted with the submount 129 in the enclosure 112. In some embodiments any component that goes directly across the AC input line may be in the base 102 and other components that assist in converting the AC to useful DC may be in the enclosure 112. In one example embodiment, the inductors and capacitor that form part of the EMI filter are in the Edison base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. Other embodiments are possible using different driver configurations. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. With boost technology there is a relatively small power loss when converting from AC to DC. For example, boost technology may be approximately 92% efficient while other power converting technology may be approximately 85% efficient.

The base 102 comprises the electrically conductive Edison screw 103 for connecting to an Edison socket and the housing portion 105 connected to the Edison screw. The Edison screw 103 may be connected to the housing portion 105 by adhesive, mechanical connector, welding, separate fasteners or the like. The housing portion 105 may comprise an electrically insulating material such as plastic. Further, the material of the housing portion 105 may comprise a thermally conductive material such that the housing portion 105 may form part of the heat sink structure for dissipating heat from the lamp 100. The housing portion 105 and the Edison screw 103 define an internal cavity 111 for receiving the electronics 110 of the lamp including the power supply and/or drivers or a portion of the electronics for the lamp. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110.

The electrical path between the PCB 80 and the LED assembly may be made by any suitable electrical conductor. In one embodiment wires or other conductors may be soldered to the PCB 80 and LED assembly 130. In other embodiments the PCB 80 may comprise an extension 80*a* that includes electrical contacts 96 and 98. The extension 80*a* extends outside of the base 102 such that a portion of the board 80 and contacts 96, 98 are exposed beyond the top edge of the base 102. The first electrical contact 96 and the second electrical contact 98 allow the lamp electronics 110 to be electrically coupled to the LED assembly 130 in the lamp. Electrical conductors such as traces 76, 78 may be formed on the PCB 80 to electrically connect the contacts 96, 98 to the lamp electronics 110. While the contacts 96, 98 are mounted on the PCB 80 that contains the lamp electronics 110, the contacts 96, 98 may be mounted on a separate extension component such as a separate printed circuit board or other support that is fixed to and extends from the base 102 where conductors extend between and electrically couple the contacts 96, 98 on the separate extension component to the lamp electronics 110 on PCB 80. While separate components may be used, mounting the contacts 96, 98 on the extension 80*a* that is formed as one-piece with the PCB 80 may be the most cost effective configuration.

In other embodiments an electrical interconnect may be used between the LED assembly and the PCB 80 that comprises electrical contacts that contact pads on the LED assembly and the PCB 80 as shown in FIGS. 6-9. The electrical interconnect 150, as well as the extension 80*a* described above, enables the electrical connection to the LEDs to be made in an easy fashion to improve manufacturability by reducing the need for soldering of the electrical contacts. The electrical contacts of the interconnect 150 and/or extension 80*a* can be configured to engage the corresponding electrical contacts in various ways to maintain a robust electrical connection in easier fashion. Such engagement can take various forms as would be understood by one of ordinary skill in the art with the benefit of this disclosure.

As shown in FIGS. 6-9, the electrical interconnect 150 comprises a body 160 that includes a first conductor 162 for connecting to one of the anode or cathode side of the LED assembly 130 and a second conductor 164 for connecting to the other one of the anode or cathode side of the LED assembly 130. The first conductor 162 extends through the body 160 to form an LED-side contact 162*a* and a lamp electronics-side contact 162*b*. The second conductor 164 extends through the body 160 to form an LED-side contact 164*a* and a lamp electronics-side contact 164*b*. Each conductor may be made of more than one component provided an electrical pathway is provided in the body 160.

A support and/or alignment mechanism is configured to position the first and/or second set of contacts relative to the corresponding electrical contacts of the LED assembly 130 and power supply and other lamp electronics 110. The support and/or alignment mechanism may comprise a first engagement member 166 on body 160 that engages a mating second engagement member 168 on the heat sink 149. In one embodiment the first engagement member 166 comprises a deformable resilient finger that comprises a camming surface 170 and a lock member 172. The second engagement member 168 comprises a fixed member located in the internal cavity 174 of the heat sink 149. The electrical interconnect 150 may be inserted into the cavity 174 from the bottom of the heat sink 149 and moved toward the opposite end of the heat sink such that the camming surface 170 contacts the fixed member 168. The engagement of the camming surface 170 with the fixed member 168 deforms the finger 166 to allow the lock member 172 to move past the fixed member 168. As the lock member 172 passes the fixed member 168 the finger 166 returns toward its undeformed state such that the lock member 172 is disposed behind the fixed member 168. The engagement of the lock member 172 with the fixed member 168 fixes the electrical interconnect 150 in position in the heat sink 149. The snap-fit connection allows the electrical interconnect 150 to be inserted into and fixed in the heat sink 149 in a simple insertion operation without the need for any additional connection mechanisms, tools or assembly steps.

The support and/or alignment arrangement may properly orient the electrical interconnect 150 in the heat sink 149 and provide a passage for the LED-side contacts 162*a*, 164*a*, and may comprise a first slot 176 and a second slot (not shown) formed in the heat sink 149. The first slot 176 and the second slot may be arranged opposite to one another and receive ears or tabs 180 that extend from the body 160. The tabs 180 are positioned in the slots such that as the electrical interconnect 150 is inserted into the heat sink 149, the tabs 180 engage the slots to guide the electrical interconnect 150 into the heat sink 149.

The first LED-side contact 162*a* and the second LED-side contact 164*a* are arranged such that the contacts extend through the first and second slots, respectively, as the electrical interconnect 150 is inserted into the heat sink 149. The contacts 162*a*, 164*a* are exposed on the outside of the heat sink 149. The contacts 162*a*, 164*a* are arranged such that they create an electrical connection to the anode side and the cathode side of the LED assembly 130 when the LED assembly 130 is mounted on the heat sink 149. The contacts 162*a*, 164*a* are resilient such that they deform to ensure a good electrical contact with the LED assembly 130.

The LED assembly 130 comprises an anode side contact 186 and a cathode side contact 188. The contacts 186, 188 may be formed as part of the conductive submount 129 on which the LEDs are mounted. For example, the contacts 186, 188 may be formed as part of the PCB, lead frame or metal circuit board or other submount 129. The contacts 186, 188 are electrically coupled to the LEDs 127 such that they form part of the electrical path between the lamp electronics 110 and the LED assembly 130. The contacts 186, 188 are positioned such that when the LED assembly 130 is mounted on the heat sink 149 the contacts 186, 188 are disposed between the LED-side contacts 162*a*, 164*a*, respectively, and the heat sink 149. The LED-side contacts 162*a*, 164*a* are arranged such that as the contacts 186, 188 are inserted behind the LED-side contacts 162*a*, 164*a*, the LED-side contacts 162*a*, 164*a* are slightly deformed. Because the LED-side contacts 162*a*, 164*a* are resilient, a bias force is created that biases the LED-side contacts 162*a*, 164*a* into engagement with the LED assembly 130 contacts 186, 188 to ensure a good electrical coupling between the LED-side contacts 162*a*, 164*a* and the LED assembly 130. The engagement between the LED-side contacts and LED assembly and/or between the electronics side contacts and the electronics is referred to herein as a contact coupling where the electrical coupling is created by the contact under pressure between the contacts as distinguished from a soldered coupling.

The first electronic-side contact 162*b* and the second electronic-side contact 164*b* are arranged such that the contacts 162*b*, 164*b* extend beyond the bottom of the heat sink 149 when the electrical interconnect 150 is inserted into the heat sink 149. The contacts 162*b*, 164*b* are arranged such that they create an electrical connection to the anode side and the cathode side of the lamp electronics 110. The contacts 162*b*, 164*b* are resilient such that they can be deformed to ensure a good electrical contact with electrical contact pads formed on PCB 80.

The LED assembly 130 may be implemented using a submount 129 where the submount comprises a flex circuit. The lamp 100 comprises a solid-state lamp comprising a LED assembly 130 with LEDs 127. Multiple LEDs 127 can be used together, forming an LED array 128. The LEDs 127 can be mounted on or fixed within the lamp in various ways. The LEDs 127 in the LED array 128 include LEDs which may comprise an LED die disposed in an encapsulant such as silicone, and LEDs which may be encapsulated with a phosphor to provide local wavelength conversion. A wide variety of LEDs and combinations of LEDs may be used in the LED assembly 130 as described herein. The LEDs 127 of the LED array 128 are operable to emit light when energized through an electrical connection.

The LED assembly 130 comprises a submount 129 arranged such that the LED array 128 is substantially in the center of the enclosure 112 and the LED's 127 are positioned at the approximate center of enclosure 112. As used herein the terms "center of the enclosure" and "optical center of the enclosure" refers to the vertical position of the LEDs in the enclosure as being aligned with the approximate largest diameter area of the globe shaped main body 114. "Vertical" as used herein means along the longitudinal axis of the bulb where the longitudinal axis extends from the base to the free end of the bulb as represented by line A-A in FIG. 1. In one embodiment, the LED array 128 is arranged in the approximate location that the visible glowing filament is disposed in a standard incandescent bulb. The terms "center of the enclosure" and "optical center of the enclosure" do not necessarily mean the exact center of the enclosure and are used to signify that the LEDs are located along the longitudinal axis of the lamp at a position between the ends of the enclosure near a central portion of the enclosure.

Figure 4:
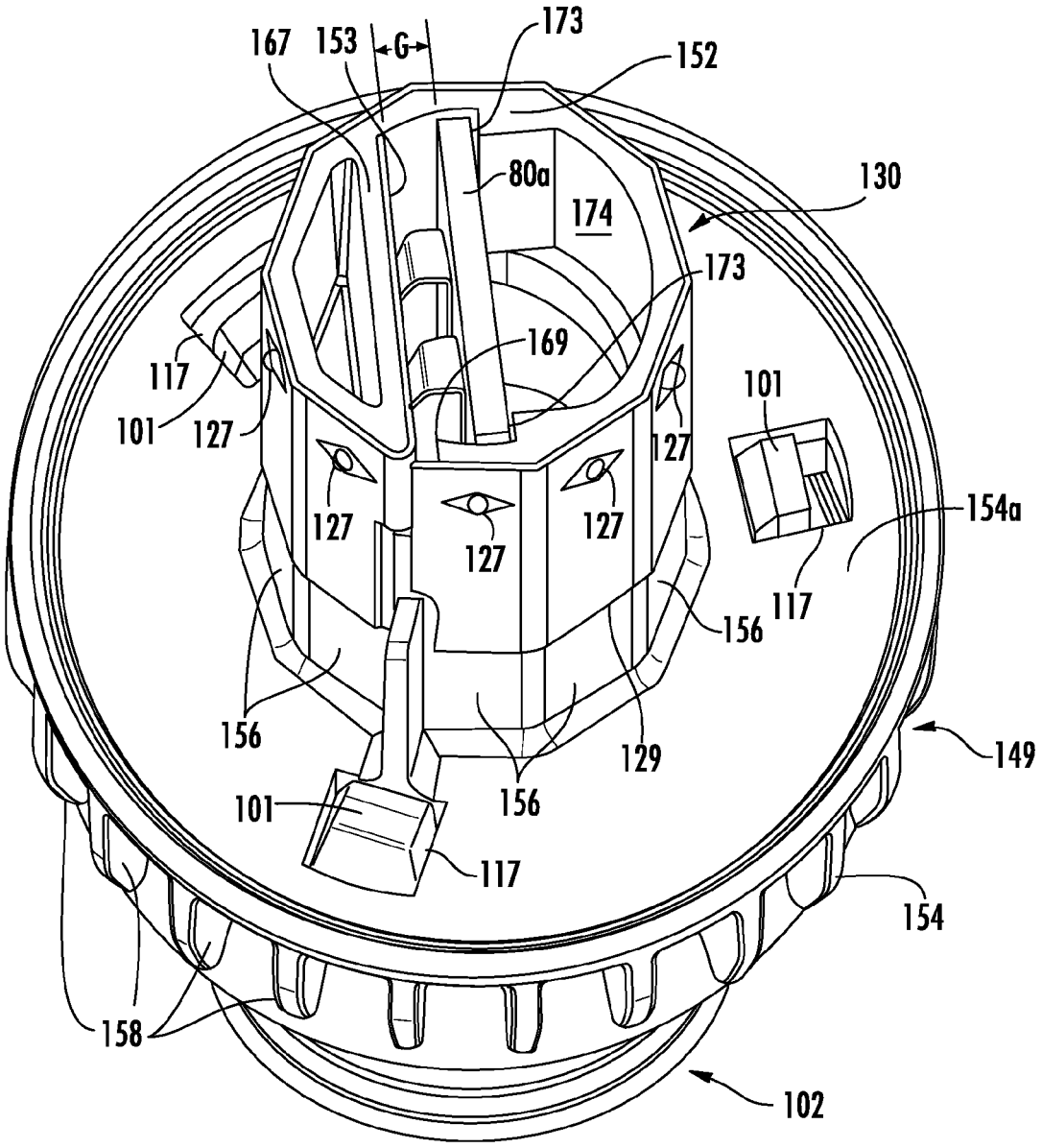
FIG. 4 is a perspective view of the base, heat sink and lamp electronics of the lamp of FIG. 1.
Figure 5:
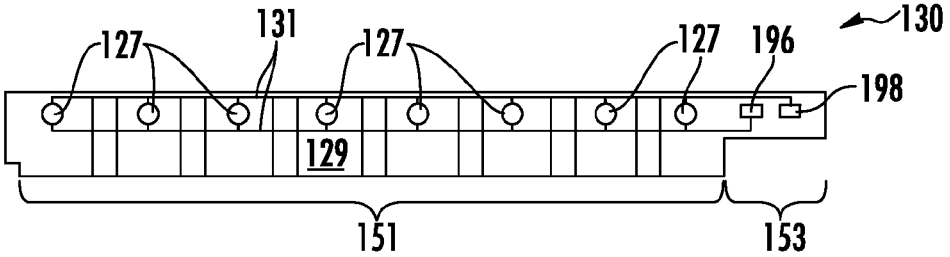
FIG. 5 is a plan view of an embodiment of an LED assembly usable in the lamp of FIG. 1.
Figure 6:
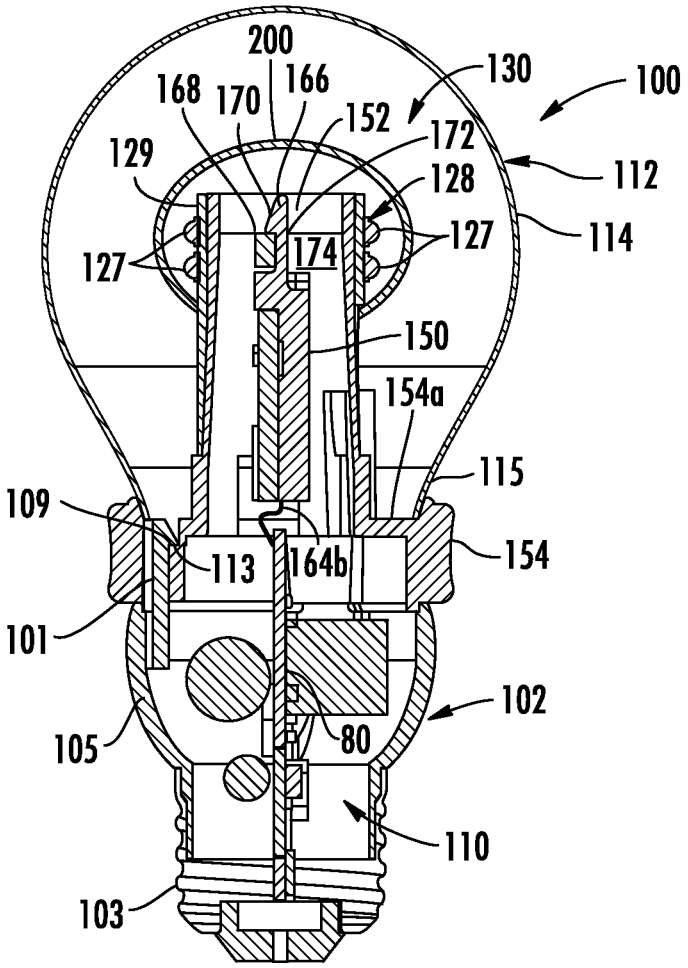
FIG. 6 is a section view similar to FIG. 2 of another embodiment of the lamp of the invention.
Figure 7:
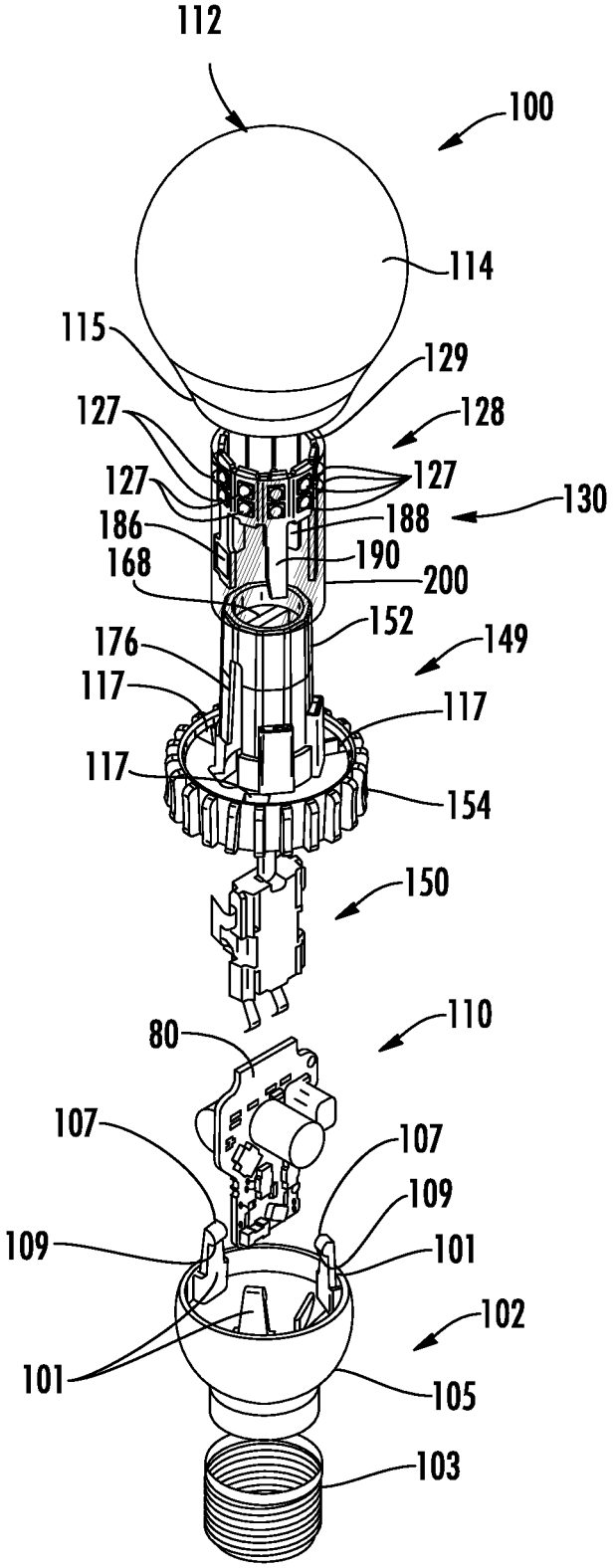
FIG. 7 is an exploded perspective view of the lamp of FIG. 6.
Figure 8:
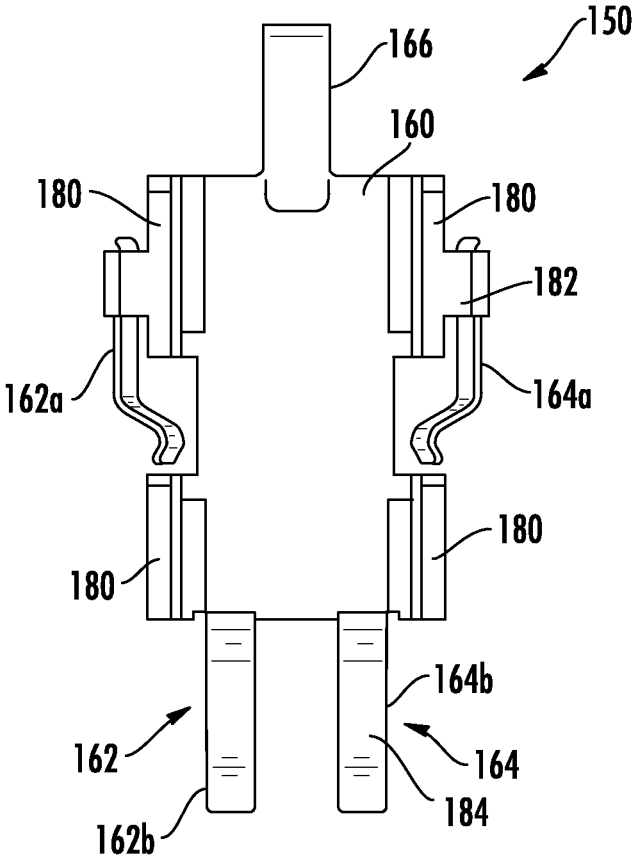
FIG. 8 is a front view of the electrical interconnect used in the lamp of FIG. 6.
Figure 9:
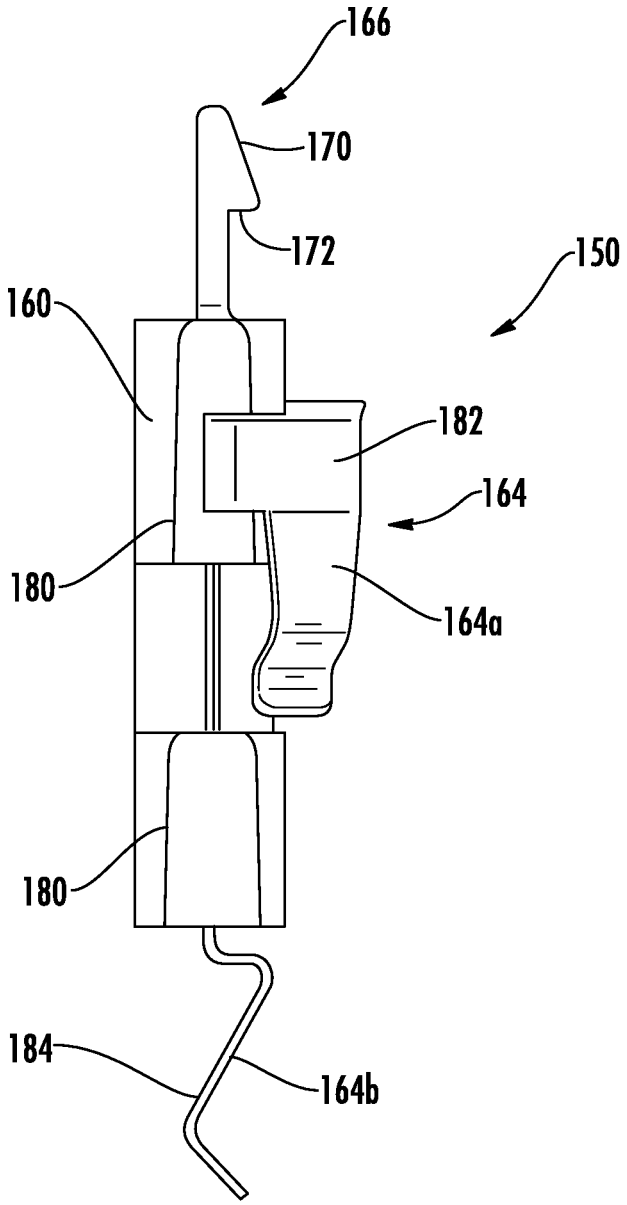
FIG. 9 is a side view of the electrical interconnect used in the lamp of FIG. 6

In some embodiments, the submount 129 may comprise a flex circuit 133 as shown in FIGS. 2, 4 and 5. The submount may be made of, or partially made of, a thermally conductive material such that heat generated by the LEDs 127 may be efficiently transferred to the heat sink 149. Referring to FIG. 5, the flex circuit 133 may comprise a first LED mounting portion 151 that functions to mechanically and electrically support the LEDs 127 and a second electrical connector portion 153 that functions to provide the electrical connection to the LED assembly 130. The submount 129 may be bent into the configuration of the LED assembly 130 as shown in the figures. The flex circuit 133 may comprise a flexible layer of a dielectric material such as a polyimide, polyester or other material to which a layer of copper or other electrically conductive material is applied such as by adhesive. Electrical traces 131 are formed in the copper layer to form electrical pads for mounting the electrical components such as LEDs 127 on the flex circuit and for creating the electrical path between the components. The copper layer may be covered by a protective layer or layers. Other embodiments of a flex circuit may also be used. In one embodiment, the exposed surfaces of the submount 129 may be coated with silver or other reflective material to reflect light inside of enclosure 112 during operation of the lamp.

The submount may comprise a series of anodes and cathodes arranged in pairs for connection to the LEDs 127. An LED or LED package containing at least one LED 127 is secured to each anode and cathode pair where the LED/LED package spans the anode and cathode. The LEDs/LED packages may be attached to the submount by soldering. In the illustrated embodiments eight pairs, ten pairs and twenty pairs of anodes and cathodes are shown for an LED assembly having eight, ten and twenty LEDs 127; however, a greater or fewer number of anode/cathode pairs and LEDs may be used. Moreover, more than one submount 129 may be used to make a single LED assembly 130. For example, two flex circuits 133 may be used to make an LED assembly 130 having twice the number of LEDs as a single flex circuit. The submount 129 may have a variety of shapes, sizes and configurations. The LED assembly 130 further comprises an anode side contact pad 196 and a cathode side contact pad 198 formed on the electrical connector portion 153 of flex circuit 133 that are electrically coupled to the lamp electronics as will be described. The contact pads 196, 198 may be formed as part of the conductive submount 129 on which the LEDs are mounted. For example, the contacts 196, 198 may be formed as part of the electrical traces 131 of the flex circuit or other submount 129.

In some embodiments, the LED lamp 100 is equivalent to a 60 Watt incandescent light bulb. In one embodiment of a 60 Watt equivalent LED bulb, the LED assembly 130 comprises an LED array 128 of 20 XLamp® XT-E High Voltage white LEDs manufactured by Cree, Inc., where each XLamp® XT-E LED has a 46 V forward voltage and includes 16 DA LED chips manufactured by Cree, Inc. and configured in series. The XLamp® XT-E LEDs may be configured in four parallel strings with each string having five LEDs arranged in series, for a total of greater than 200 volts, e.g. about 230 volts, across the LED array 128. In another embodiment of a 60 Watt equivalent LED bulb, 20 XLamp® XT-E LEDs are used where each XT-E has a 12 V forward voltage and includes 16 DA LED chips arranged in four parallel strings of four DA chips arranged in series, for a total of about 240 volts across the LED array 128 in this embodiment. In some embodiments, the LED lamp 100 is equivalent to a 40 Watt incandescent light bulb. In such embodiments, the LED array 128 may comprise 10 XLamp® XT-E LEDs where each XT-E includes 16 DA LED chips configured in series. The 10 46V XLamp® XT-E® LEDs may be configured in two parallel strings where each string has five LEDs arranged in series, for a total of about 230 volts across the LED array 128. In some embodiments eight LEDs may be used, operated at a higher voltage to provide a 40 Watt equivalent LED lamp. In other embodiments, different types and numbers of LEDs are possible, such as XLamp® XB-D LEDs manufactured by Cree, Inc. or others. Other arrangements of chip on board LEDs and LED packages may be used to provide a LED based lamp equivalent to 40, 60 and/or greater other watt incandescent light bulbs. The LEDs may be encapsulated with a phosphor to provide local wavelength conversion; however, in some embodiments the phosphor may be provided remotely from the LEDs as will be described later.

In one embodiment, the flex circuit 129 is formed as a flat member that is bent into a suitable three-dimensional shape such as a cylinder, sphere, polyhedra or the like to form LED assembly 130. Because the flex circuit is made of thin bendable material, and the anodes and cathodes may be positioned on the flex circuit in a wide variety of locations, and the number of LEDs may vary, the flex circuit may be configured such that it may be bent into a wide variety of shapes and configurations.

Figure 10:
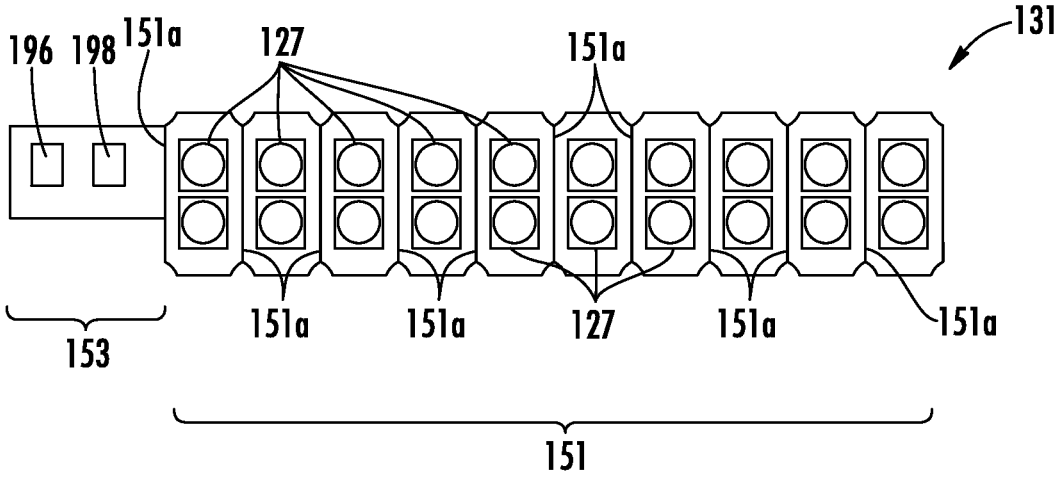
FIG. 10 is a plan view of another embodiment of an LED assembly usable in the lamp of the invention.
Figure 11:
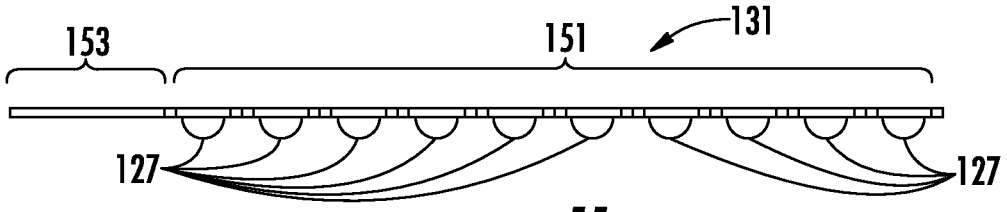
FIG. 11 is a top view of the LED assembly of FIG. 10.

In another embodiment of LED assembly 130 the submount 129 may comprise a metal core board 131 such as a metal core printed circuit board (MCPCB) as shown in FIGS. 10 and 11. The metal core board comprises a thermally and electrically conductive core made of aluminum or other similar pliable metal material. The core is covered by a dielectric material such as polyimide. Metal core boards allow traces to be formed therein. In one method, the core board is formed as a flat member and is bent into a suitable shape such as a cylinder, sphere, polyhedra or the like. Similar to a flex circuit the core board is made of thin bendable material such that it may be bent into a wide variety of shapes and configurations. In one embodiment the core board is formed as a flat member having a first LED mounting portion on which the LEDs/LED packages containing LEDs 127 are mounted. The first portion may be divided into sections by thinned areas or score lines 151*a*. The LEDs/LED packages are located on the sections such that the core board may be bent along the score lines 151*a* to form the planar core board into a variety of three-dimensional shapes where the shape is selected to project a desired light pattern from the lamp 100.

Figure 12:
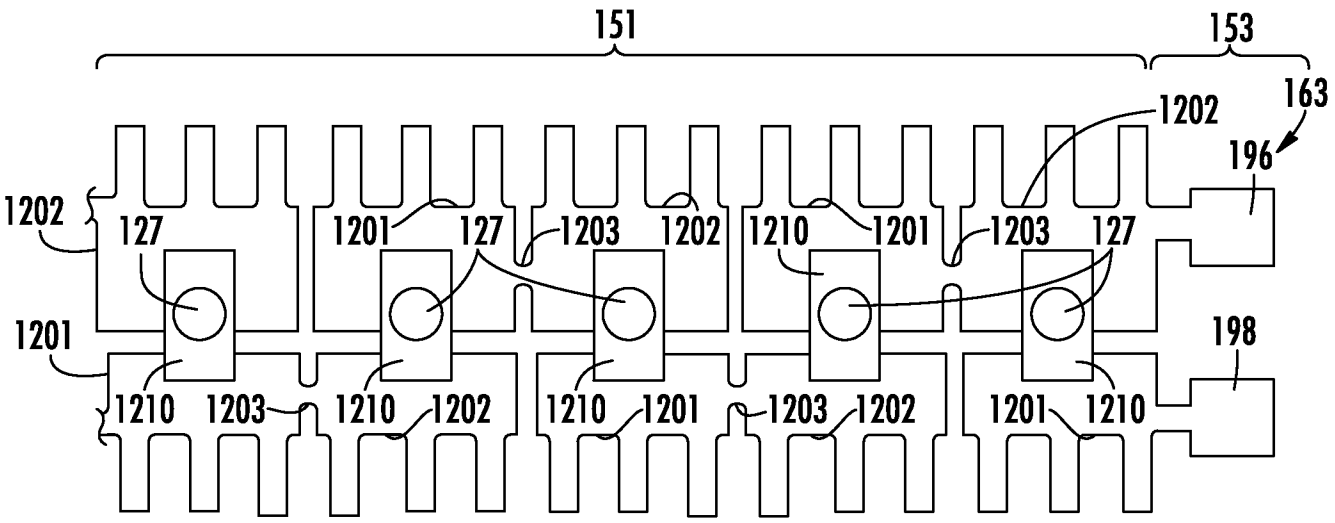
FIG. 12 is a plan view of yet another embodiment of an LED assembly usable in the lamp of FIG. 1.

The submount 129 may also comprise a bendable lead frame 163 made of an electrically conductive material such as copper, copper alloy, aluminum, steel, gold, silver, alloys of such metals, thermally conductive plastic or the like as shown in FIG. 12. In one embodiment, the exposed surfaces of lead frame 163 may be coated with silver or other reflective material to reflect light inside of enclosure 112 during operation of the lamp. The lead frame 163 comprises a series of anodes 1201 and cathodes 1202 arranged in pairs for connection to the LEDs 1127. In the illustrated embodiment five pairs of anodes and cathodes are shown for an LED assembly having five LEDs 127; however, a greater or fewer number of anode/cathode pairs and LEDs may be used. Connectors 1203 connect the anode 1201 from one pair to the cathode 1202 of the adjacent pair to provide the electrical path between the pairs during operation of the LED assembly 1130. An LED or LED package containing at least one LED 127 is secured to each anode and cathode pair where the LED/LED package spans the anode and cathode. The LEDs/LED packages may be attached to the lead frame by soldering.

The submount 129 may be bent or folded such that the LEDs 127 provide the desired light pattern in lamp 100. In one embodiment the submount 129 is bent into a generally cylindrical shape as shown in the figures. The LEDs 127 are disposed on the submount 129 about the axis of the cylinder such that light is projected outward. The LEDs 127 may be arranged around the perimeter of the LED assembly to project light radially. In some embodiments one of the LEDs 127 may be angled toward the bottom of the LED assembly 130 and another one of the LEDs 127 may be angled toward the top of the LED assembly 130 with the remaining LEDs projecting light radially from the LED assembly 130. Angling selected ones of the LEDs may be used to increase the amount of light that is projected toward the bottom and/or top of the lamp. The orientations of the LEDs and the number of LEDs may be varied to create a desired light pattern. For example, FIGS. 2, 4 and 5 show an embodiment of a single tiered LED assembly 130 where a single row of LEDs comprises a series of a plurality of LEDs 127 arranged around the perimeter of the cylinder. The LED assembly may comprise two tiers of LEDs, as shown in FIGS. 6, 7, 10 and 11 three tiers or additional tiers of LEDs where each tier comprises a plurality of LEDs 127 arranged around the perimeter of the cylinder. The LED array 128 may be shaped other than as a cylinder such as a polyhedron, a helix, double helix, or other shape. In the illustrated embodiments the submount 129 and heat sink 149 are formed to have a generally cylindrical shape; however, the submount and heat sink may have a generally triangular cross-sectional shape, other polygonal shape or even more complex shapes.

The LED assembly 130 may be formed to have any of the configurations shown and described herein or other suitable three-dimensional geometric shape. The LED assembly 130 may be advantageously bent or formed into any suitable three-dimensional shape. A "three-dimensional" LED assembly as used herein and as shown in the drawings means an LED assembly where the submount comprises mounting surfaces for different ones of the LEDs that are in different planes such that the LEDs mounted on those mounting surfaces are also oriented in different planes. In some embodiments the planes are arranged such that the LEDs are disposed over a 360 degree range. The submount may be bent from a flat configuration, where all of the LEDs are mounted in a single plane on a generally planar member, into a three-dimensional shape where different ones of the LEDs and LED mounting surfaces are in different planes.

LEDs and/or LED packages used with an embodiment of the invention and can include light emitting diode chips that emit hues of light that, when mixed, are perceived in combination as white light. Phosphors can be used to provide other colors of light by wavelength conversion. For example, blue or violet LEDs can be used in the LED assembly of the lamp and the appropriate phosphor can be used to create bright white light. In some embodiments LED devices can be used with phosphorized coatings packaged locally with the LEDs such as by providing phosphor in the silicone lens for the LED die. For example, blue-shifted yellow (BSY) LED devices, which may include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference. In some embodiments the phosphor may be localized where the phosphor is applied directly to the LED or LED package. For example, the phosphor may be incorporated into the lens for the individual LEDs. In some embodiments, the performance of the localized phosphor may degrade over time as a result of the heat generated by the LEDs and/or the intensity of the light near the LED. The lamp of the invention allows the phosphor to be provided remotely from the LEDs to eliminate or minimize these problems as will hereinafter be described.

Referring again to the figures, the LED assembly 130 may be mounted to the heat sink structure 149. The heat sink structure 149 comprises a heat conducting portion or tower 152 and a heat dissipating portion 154. In one embodiment the heat sink 149 is made as a one-piece member of a thermally conductive material such as aluminum. The heat sink structure 149 may also be made of multiple components secured together to form the heat sink. Moreover, the heat sink 149 may be made of any thermally conductive material or combinations of thermally conductive materials.

The heat conducting portion 152 is formed as a tower that is dimensioned and configured to make good thermal contact with the LED assembly 130 such that heat generated by the LED assembly 130 may be efficiently transferred to the heat sink 149. While the LED assembly 130 and the heat conducting portion 152 are shown as being generally cylindrical these components may have any configuration provided good thermal conductivity is created between the LED assembly 130 and the heat conducting portion 152. The submount 129 is mounted on the heat conducting portion 152 by forming the submount 129 to have a mating complimentary shape to the exterior surface of the heat conducting portion 152. The LED mounting portion 151 is positioned on the exterior of the heat conducting portion 152 such that the LEDs 127 face outwardly. While in some embodiments the heat conducting portion is formed as the tower that supports the LED assembly 130, the tower may be made of a thermally non-conductive material such as plastic and the heat conducting portion may be a separate component, such as aluminum rods, that thermally couple the LED assembly to the heat dissipating portion 154.

The heat dissipating portion 154 is in thermally coupled to the heat conducting portion 152 such that heat conducted away from the LED assembly 130 by the heat conducting portion 152 may be efficiently dissipated from the lamp 100 by the heat dissipating portion 154. In one embodiment the heat conducting portion 152 and heat dissipating portion 154 are formed as one-piece. The heat dissipating portion 154 extends to the exterior of the lamp 100 such that heat may be dissipated from the lamp to the ambient environment. In one embodiment, the heat dissipating portion 154 comprises a plurality fins 158 that extend outwardly to increase the surface area of the heat dissipating portion 154. The heat dissipating portion 154 and heat dissipating members 158 may have any suitable shape and configuration. Different embodiments of the LED assembly and heat sink tower are possible. In various embodiments, the LED assembly may be relatively shorter, longer, wider or thinner than that shown in the illustrated embodiment.

The heat conducting portion 152 defines an internal cavity 174 that is dimensioned to receive the extension **80*a* or the interconnect 150. In one embodiment the internal cavity 174 comprises a first support surface 167 that supports the electrical connection portion 153 of the submount 129 such that the electrical connection portion 153 is supported in a fixed position internally of the heat conducting portion 152. A slot or aperture 169 is provided in the wall of the heat conducting portion 152 to communicate the interior cavity 174 with the exterior of the heat conducting portion 152. The aperture 169 is positioned adjacent the support surface 167**.

In one embodiment the electrical conductor portion 153 of the LED submount 129 is inserted into the aperture 169 such that the contact pads 196 and 198 are located inside of the heat conducting portion 152 and are exposed to the interior of the heat conducting portion 152. The back surface of the electrical connection portion 153 abuts against the support surface 167. The LED mounting portion 151 of the LED submount 129 wraps around and closely engages the outer periphery of the heat conducting portion 152.

To provide the electrical connection between the LED assembly 130 and the lamp electronics 110, the extension 80*a* is positioned in the interior cavity 160 of the heat conducting portion 152 of the heat sink 149. A portion of the extension 80*a* is disposed opposite to the electrical connector portion 153 of the submount 129 that comprises the anode side contact pad 196 and a cathode side contact pad 198. The electrical contacts 96 and 98 are mounted on the board 80 in a position opposite to the electrical contact pads 196, 198 on the submount 129 such that when the board 80 is inserted into the heat conducting portion 152 the contacts 96 and 98 are disposed opposite to and contact the pads 196 and 198 formed on the flex circuit to complete the electrical path between the electronics 110 on the PCB 80 and the LED assembly 130. In one embodiment the contacts 96, 98 are resilient members that deformably engage the contact pads 196, 198 formed on the flex circuit 129 such that the resiliency of the contacts 96, 98 biases the contacts 96, 98 into engagement with the pads 196, 198. While the deformable resilient contacts 96, 98 are shown as being mounted on the board 80 the parts may be reversed such that the deformable resilient contacts are on the LED submount 129 and the pads 96, 98 are on the extension 80*a*, 99. Moreover, the biasing force may be created using a separate biasing mechanism rather than using the resiliency of the contacts 96, 98. The engagement between the contacts 96, 98 and the and the anode side and the cathode side contact pads 196, 198 of the LED assembly 130 is referred to herein as a contact coupling where the electrical coupling is created by the contact under pressure between the contacts 96, 98 and pads 196, 198, as distinguished from a soldered coupling.

The electrical connector portion 153 of the submount 129 is disposed against the internal support surface 167 of the heat sink 149 such that the contact pads 196, 198 are supported in a fixed position. The back of the extension 80*a* (the back being the side of the extension opposite to the contacts 96, 98) abuts internal support surfaces 173 inside of the heat conducting portion 152 such that the extension 80*a* is also held in a fixed position in the heat conducting portion 152. The distance between the support surface 167 and the support surfaces 173 defines a gap G between the extension 809 and the electrical connector portion 153 of submount 129. The width of the gap G is selected to deform the contacts 96, 98 a determined mount where the deformation of the contacts generates a desired bias force between the contacts 96, 98 and the pads 196, 198 sufficient to create a good electrical connection between these components. The live electrical components are located inside of the heat conducting portion 152 such that the live electrical components are contained within the heat conducting portion 152 and are isolated from the external environment.

The size of the gap G may be is selected such that the live electrical components, such as contacts 96, 98 and pads 196,198 are safely isolated from a user in the event of enclosure failure. Typical standards specify a maximum allowable gap or opening size through which electrical components are accessible. The gap or opening size is small enough that that a user's finger is prevented from contacting live electrical components. In the lamp of the invention the width of gap G may be selected to be smaller or the same size as the specified maximum of the appropriate standard. In some embodiments, the top of the heat conducting portion 152 may be closed or covered by an additional cover piece such that the electrical contacts located in internal space 160 are completely isolated from a user in the event that the enclosure 112 fails.

To secure the base 102 to the heat sink 149, first engagement members on the base 102 may engage mating second engagement members on the heat sink structure 149. In one embodiment, the first engagement members comprise deformable resilient fingers 101 that comprise a camming surface 107 and a lock member 109. The second engagement member comprises apertures 117 formed in the heat sink 149 that are dimensioned to receive the fingers 101. In one embodiment, the housing 105 of the base 102 is provided with fingers 101 that extend from the base 102 toward the heat sink 149. In the illustrated embodiment three fingers 101 are provided although a greater or fewer number of fingers may be provided. The fingers 101 may be made as one-piece with the housing 105. For example, the housing 105 and fingers 101 may be molded of plastic. The apertures 117 define fixed members 113 that may be engaged by the lock members 109 to lock the fingers 101 to the heat sink 149. The base 102 may be moved toward the bottom of the heat sink 149 such that fingers 101 are inserted into apertures 117 and the camming surfaces 107 of the fingers 101 contact the fixed members 113. The engagement of the fixed members 113 with the camming surfaces 107 deforms the fingers 101 to allow the locking members 109 to move past the fixed members 113. As the lock members 109 pass the fixed members 113 the fingers 101 return toward their undeformed state such that the lock members 109 are disposed behind the fixed members 113. The engagement of the lock members 109 with the fixed members 113 fixes the base 102 to the heat sink 149. The snap-fit connection allows the base 102 to be fixed to the heat sink 149 in a simple insertion operation without the need for any additional connection mechanisms, tools or assembly steps. While one embodiment of the snap-fit connection is shown numerous changes may be made. For example, the deformable members such as fingers may be formed on the heat sink 149 and the fixed members such as apertures may be formed on the base 102. Moreover, both engagement members may be deformable. Further, rather than using a snap-fit connection, the electrical interconnect 150 may be fixed to the heat sink using other connection mechanisms such as a bayonet connection, screwthreads, friction fit, adhesive, mechanical connectors or the like.

The enclosure 112 may be attached to the heat sink 149. In one embodiment, the LED assembly 130 and the heat conducting portion 152 are inserted into the enclosure 112 through the neck 115. The neck 115 and heat sink dissipation portion 154 are dimensioned and configured such that the rim of the enclosure 112 sits on the upper surface 154*a* of the heat dissipation portion 154 with the heat dissipation portion 154 disposed at least partially outside of the enclosure 112, between the enclosure 112 and the base 102. To secure these components together a bead of adhesive may be applied to the upper surface 154*a* of the heat dissipation portion 154. The rim of the enclosure 112 may be brought into contact with the bead of adhesive to secure the enclosure 112 to the heat sink 149 and complete the lamp assembly. In addition to securing the enclosure 112 to the heat sink 149 the adhesive may be deposited over the snap-fit connection formed by fingers 101 and apertures 117. The adhesive flows into the snap fit connection to permanently secure the heat sink to the base.

In order overcome issues relating to the exposure of live electrical components in the event of enclosure failure, the problems associated with localized phosphors on the LEDs and/or the expense of treating or manufacturing the enclosure 112 with light modifying technologies, an optical interface 200 is provided internally of the enclosure that surrounds the LED assembly or portions of the LED assembly to isolate the LED assembly and/or to optically modify the light emitted by the LEDs as shown, for example, in FIGS. 2, 6, 7 and 13. The optical interface 200 may have a variety of shapes and sizes and may be made of a variety of materials as will hereinafter be described. The optical interface may be shaped based on the function of the interface including the light modifying properties of the interface. The optical interface 200 may be made of an electrically insulating or dielectric material to provide electrical isolation of the live electrical components.

In one embodiment the optical interface 200 is formed of glass or other transparent material and surrounds the LEDs 127 and any exposed electrically active components that may be in the electrical path to the LED assembly. For example the optical element may surround the LED assembly or a portion of the LED assembly such that in the event that the enclosure 112 breaks, the optical interface 200 electrically isolates any live electrical components from a person. The optical interface 200 may be made of a transparent material such that light emitted from the LEDs is not affected by the optical interface. In one embodiment glass may be used because of its low cost. In such an embodiment the optical interface 200 is used to provide physical and electrical isolation of the electrical components of the lamp. The optical interface 200 may be made of glass provided that the optical interface 200 physically survives any applicable electrical isolation test of the lamp, such as the UL drop test. In some embodiments the optical interface may be made of a shatter resistant material such as clear plastic, quartz or the like. As used herein "shatter resistant" means that a component by virtue of its material or materials, construction and/or combinations of materials and/or construction retains enough structural integrity that it electrically isolates the electrical components as required by the applicable standard such as the UL standard discussed above. A shatter resistant component does not mean that the component does not break or fracture to any extent or that it may fail under other conditions. Moreover, the optical interface 200 may be made of glass or other frangible material that is provided with a shatter resistant coating to further protect the lamp electronics. While the use of a shatter resistant material or coating increases the cost and manufacturing processes of the optical interface 200, a cost and time saving still results when compared to making the entire enclosure 112 shatter resistant because the optical interface 200 has a significantly smaller surface area than the enclosure 112. Moreover, where a plastic material is used to make the optical interface 200 or a coating is applied to the interface 200, the look and feel of the outer enclosure 112 is not affected such that the lamp may be provided with a traditional glass enclosure that has the look and feel of a traditional incandescent bulb.

Figure 15:
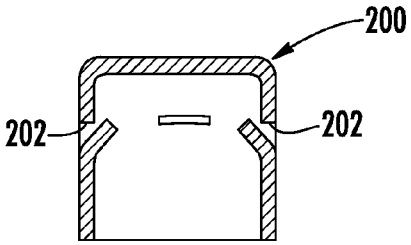
FIG. 15 is a section view of an alternate embodiment of the optical interface.
Figure 17:
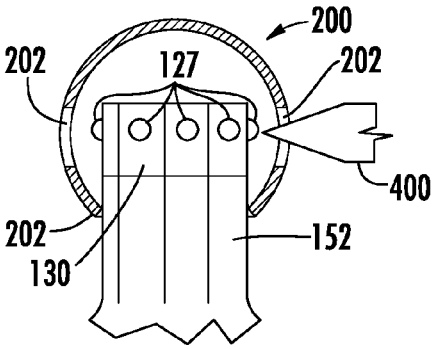
FIG. 17 is a section view of an alternate embodiment of the optical interface mounted over an LED assembly.

While the optical interface 200 may completely surround the live electrical components of the lamp, such as by completely surrounding and isolating the LED assembly 130, in some embodiments it may be desirable to allow air flow between the LED assembly 130 and the gas in the enclosure 112. Such air flow may be desirable to control the thermals of the lamp and to assist in cooling the LEDs 127. In such an embodiment openings or passages 202 may be formed in the optical interface 200 and/or between the optical interface 200 and the LED assembly 130 in order to allow air flow therebetween as shown in FIGS. 2, 13, 14, 15 and 17. The passages 202 may be arranged such that the electrical isolation of the live electrical components is maintained in the event enclosure 112 breaks. Referring to FIG. 17, for example, in one UL test for electrical isolation a probe 400 is used that simulates a human finger where the probe is inserted into or between elements to determine if the probe can contact live electrical components. The passages 202 may be arranged such that the probe cannot enter into the passages a sufficient distance that live electrical components are contacted and/or that the insertion of the probe into the passages 202 does not result in live electrical components being contacted. For example, a width dimension of the passages 202 may be made small enough that the probe is prevented from being inserted into the passages 202 a sufficient distance to reach the live electrical components. In other embodiments the passages 202 may be disposed relative to the LED assembly such that the passages are not positioned opposite live components. In such an arrangement the probe may be inserted into the passages 202, however, the passages are arranged such that the probe does not contact live components. In other embodiments, the passages 202 may have a labyrinth or serpentine shape, as shown in FIG. 15, such that air may circulate through the passages but a probe may not be inserted through the passages. In other embodiments the optical interface may be used with other isolation techniques such as a shatter resistant enclosure 112 or the isolation of the electrical components described with respect to the embodiment of FIG. 4.

Figure 18:
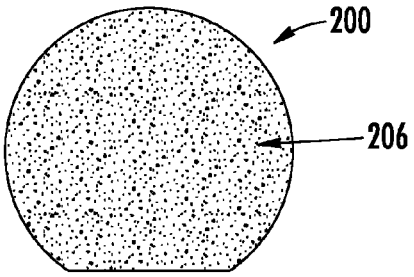
FIG. 18 is a side view of an alternate embodiment of the optical interface.

In other embodiments the optical interface 200 may be used to optically modify a characteristic of the light emitted from the LEDs as well as to physically and electrically isolate the live electrical components. The optical interface 200 may be provided with light modifying properties to modify light characteristics of the light. For example, the optical interface 200 may be made of glass comprising one or more rare earth element (REE) compounds 206, such as neodymium, or have a coating comprising one or REE compounds deposited on an interior and/or exterior surface of the interface as shown in FIG. 18. The neodymium in the glass may be used to filter out yellow light, resulting in a whiter light emitted from the lamp. While neodymium provides improved light color in some applications, it is relatively expensive such that providing neodymium on the entire enclosure 112 is expensive. Providing the optical interface 200 with the REE light modifying properties provides a more cost effective application of the lighting modifying properties than treating the entire enclosure due to the reduction of the surface area.

REE compounds are inclusive of inorganic or organometallic compounds, and independently, their salts, hydrates, and de-hydrate, and is also inclusive of all polymorphic forms thereof. The one or more REE compounds can be, for example, one or more compounds of neodymium, didymium, dysprosium, erbium, holmium, praseodymium and thulium.

In one embodiment, the one or more REE compounds are selected from neodymium(III) nitrate hexahydrate ($Nd(NO_3)_3.6H_2O$); neodymium(III) acetate hydrate ($Nd(CH_3CO_2)_3.xH_2O$); neodymium(III) hydroxide hydrate ($Nd(OH)_3$); neodymium(III) phosphate hydrate ($NdPO_4.xH_2O$); neodymium(III) carbonate hydrate ($Nd_2(CO_3)_3.xH_2O$); neodymium(III) isopropoxide ($Nd(OCH(CH_3)_2)_3$); neodymium (III) titanante ($Nd_2O_3$ titanate.$xTiO_2$); neodymium(III) chloride hexahydrate ($NdCl_3.6H_2O$); neodymium(III) fluoride ($NdF_3$); neodymium(III) sulfate hydrate ($Nd_2(SO_4)_3.xH_2O$); neodymium(III) oxide ($Nd_2O_3$); erbium(III) nitrate pentahydrate ($Er(NO_3)_3.5H_2O$); erbium(III) oxalate hydrate ($Er_2(C_2O_4)_3.xH_2O$); erbium(III) acetate hydrate ($Er(CH_3CO_2)_3.xH_2O$); erbium(III) phosphate hydrate ($ErPO_4.xH_2O$); erbium(III) oxide ($Er_2O_3$); Samarium(III) nitrate hexahydrate ($Sm(NO_3)_3.6H_2O$); Samarium(III) acetate hydrate ($Sm(CH_3CO_2)_3.xH_2O$); Samarium(III) phosphate hydrate ($SmPO_4.xH_2O$); Samarium(III) hydroxide hydrate ($Sm(OH)_3.xH_2O$); samarium(III) oxide ($Sm_2O_3$); holmium(III) nitrate pentahydrate ($Ho(NO_3)_3.5H_2O$); holmium(III) acetate hydrate ($(CH_3CO_2)_3Ho.xH_2O$); holmium(III) phosphate ($HoPO_4$); and holmium(III) oxide ($Ho_2O_3$). Other REE compounds, including organometallic compounds, for example alexandrite ($BeAl_2O_4$), or other compounds of neodymium, didymium, dysprosium, erbium, holmium, praseodymium and thulium can be used. In other embodiments, the one or more-REE's can be present in solutions, e.g., for dip coating, spraying, etc., and in polymeric films, the films thereof having a thickness tailored to the optical properties of the REE compound and/or the LEDs used, including, for example, absorbance of some the LED light by the polymeric film, such as UV light. Film thickness of the above films with effective notch filtering loadings can be between about 0.001 micron thick to about 1 millimeter thick. Other thickness or more specific thickness, based on the REE compound optical properties (or the combination of a plurality of REE's) can be determined and employed. In one aspect, the REE is a lanthanide oxide, e.g., neodymium oxide (or neodymium sesquioxide).

In some embodiments, depending on the LEDs used, the optical interface may be made of glass which has been doped with a rare earth compound, in this example, neodymium oxide. Such an optical element could also be made of a polymer, including an aromatic polymer such as an inherently UV stable polyester. The optical interface is transmissive of light. However, due to the neodymium oxide in the glass, light passing through the optical interface is filtered so that the light exiting the optical interface exhibits a spectral notch. A spectral notch is a portion of the color spectrum where the light is attenuated, thus forming a "notch" when light intensity is plotted against wavelength. Depending on the type or composition of glass or other material used to form the optical interface, the amount of neodymium compound present, and the amount and type of other trace substances in the optical interface, the spectral notch can occur between the wavelengths of 520 nm and 605 nm. In some embodiments, the spectral notch can occur between the wavelengths of 565 nm and 600 nm. In other embodiments, the spectral notch can occur between the wavelengths of 570 nm and 595 nm. Such systems are disclosed in U.S. patent application Ser. No. 13/341,337, filed Dec. 30, 2011, titled "LED Lighting Using Spectral Notching" which is incorporated herein by reference in its entirety.

Figure 19:
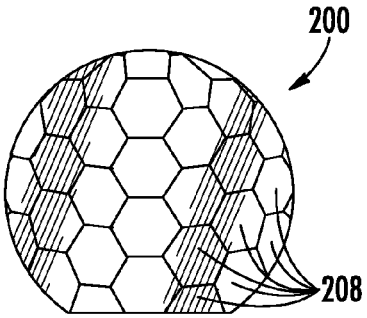
FIG. 19 is a side view of another alternate embodiment of the optical interface.
Figure 20:
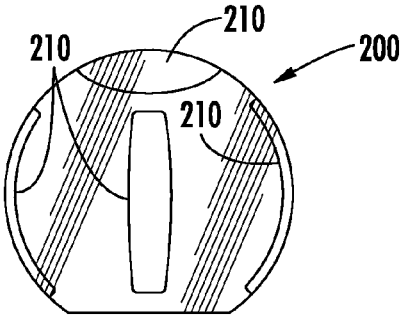
FIG. 20 is a side view of still another alternate embodiment of the optical interface.
Figure 21:
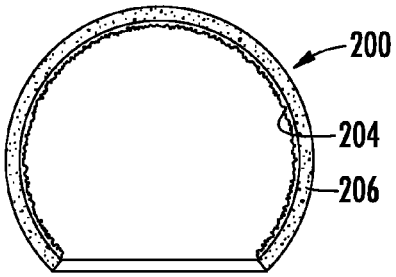
FIG. 21 is a section view of yet another embodiment of the optical interface.

The optical interface 200 may be provided with other light modifying properties. For example, the optical interface 200 may have light scattering properties or index matching properties. In another example of a light modified property, the optical interface may comprise facets 208 to enhance the color mixing of the light emitted from LEDs 127 as shown in FIG. 19. The optical interface may be provided with light diffusive or light reflective areas 210 to change the geometry of the light pattern emitted from the optical interface 200 as shown in FIG. 20. For example areas 210 of the optical interface may be made more or less light diffusive or reflective than other areas of the optical interface to modify the light pattern emitted from the optical interface and from the lamp. In another embodiment the entire optical interface may be diffusive or the entire surface of the optical interface may be provided with a diffusive layer. In another embodiment, the optical interface 200 may be provided with multiple light modifying properties if desired such that the optical interface provides more than one light modifying property. For example, the optical interface may be a REE glass 206 provided with a layer of diffusive material 204 on the interior surface thereof as shown in FIG. 21. As used herein a light modifying property is a property of the optical interface, such as a REE, a faceted or diffusive surface, or the like that modifies a characteristic of the light, such as color or pattern, that is changed or altered as the light passes through the optical interface.

Figure 16:
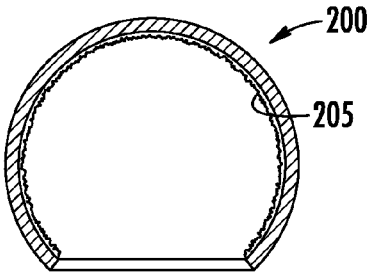
FIG. 16 is a section view of another embodiment of the optical interface.

In other embodiments a phosphor may be applied to the optical interface 200. For example, where the performance of a localized phosphor is a concern, or for other reasons, it may be desirable to provide a phosphor remote from the LEDs 127. For example the optical interface 200 may be coated with or otherwise impregnated with a phosphor 205 such that the phosphor modifies the light emitted from the LEDs 127 to color tune the light before it is emitted from the enclosure as shown in FIG. 16. Using the optical interface 200 as a phosphor dome may eliminate the need to provide local phosphor on the LEDs 127. As a result potential degradation issues associated with the local phosphor's long term exposure to the heat and light intensity of the LEDs is eliminated or minimized. The use of a phosphor optical interface inside of enclosure 112 provides a more cost effective application of phosphor than coating the entire enclosure 112 with phosphor due to the much smaller surface area of the optical interface 200 as compared to the surface area of the enclosure 112. The phosphor may be used in addition to the other light modifying properties applied to the optical interface such that the optical interface modifies a characteristic of the light and provides a remote phosphor layer.

In another embodiment the optical interface 200 may be provided as a flexible or elastic member rather than as a rigid member. The optical interface 200 may be made of a flexible, elastomeric or elastic material such as silicone or other polymer or elastomer that allows the passage of light through the material. The optical interface may be used as previously described to electrically isolate the live electrical components and to optically modify the light. The silicone may be provided with light modifying properties to modify a characteristic of the light such as a diffusive layer, REE or the like. The silicone or other elastic material may be formed into any suitable shape such as by a molding process. The optical interface is not applied as a coating such that the optical interface is a structurally separate component from the LEDs or LED assembly. Because the optical interface is a relatively soft, elastic material, the optical interface is shatter resistant as previously defined.

The optical interface may be used in various embodiments of LED lamps. FIG. 13 shows an embodiment of a lamp that uses the LED assembly 130, heat sink with the tower arrangement 149, electrical connection and optical interface as previously described in a directional lamp such as a replacement for a BR or a PAR style bulb. The previous embodiments of a lamp refer more specifically to an omnidirectional lamp such as an A series replacement bulb. In the BR or PAR lamp the light is emitted in a directional pattern rather than in an omnidirectional pattern. Standard BR type bulbs are reflector bulbs that reflect light in a directional pattern; however, the beam angle is not tightly controlled and may be up to about 90-100 degrees or other fairly wide angles. In a PAR type lamp the light is also emitted in a directional pattern. Standard PAR bulbs are reflector bulbs that reflect light in a direction where the beam angle is tightly controlled using a parabolic reflector. PAR lamps may direct the light in a pattern having a tightly controlled beam angle such as, but not limited to, 10°, 25° and 40°. The bulb shown in FIG. 13 is a directional lamp and may be used as a solid state replacement for such a reflector type BR and/or PAR bulb or other similar bulbs.

The lamp comprises a base 102, heat sink 149, LED assembly 130 and electrical connection as previously described. As previously explained, the LED assembly 130 generates an omnidirectional light pattern. To create a directional light pattern, a primary reflector 300 is provided that reflects light generated by the LED assembly 130 generally in a direction along the axis of the lamp. Where the lamp is intended to be used as a replacement for a BR type lamp the reflector 300 may reflect the light in a generally wide beam angle and may have a beam angle of up to approximately 90-100 degrees. As a result, the reflector 300 may comprise a variety of shapes and sizes provided that light reflecting off of the reflector 300 is reflected generally along the axis of the lamp. The reflector 300 may, for example, be conical, parabolic, hemispherical, faceted or the like. In some embodiments, the reflector may be a diffuse or Lambertian reflector and may be made of a white highly reflective material such as injection molded plastic, white optics, PET, MCPET, or other reflective materials. The reflector may reflect light but also allow some light to pass through it. The reflector 300 may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet.

The reflector 300 may be mounted on the heat sink 149 or LED assembly 130 using a variety of connection mechanisms. In one embodiment, the reflector 300 is mounted on the heat conducting portion or tower 152 of the heat sink 149. The reflector may also be mounted on the heat dissipating portion 154 of the heat sink 149 or to enclosure 302. The reflector 300 may be mounted to the heat sink 149 or LED assembly 130 using separate fasteners, adhesive, friction fit, mechanical engagement such as a snap-fit connection, welding or the like.

The enclosure 302 is typically coated on an interior surface with a highly reflective material such as aluminum to create a reflective surface 310 and an optically transmissive exit surface 308 through which the light exits the lamp. The exit surface 308 may be frosted or otherwise treated with a light diffuser material. As previously explained, the reflector 300 may be positioned such that it reflects some of the light generated by the LED assembly 130. However, at least a portion of the light generated by the LED assembly 130 may not be reflected by the reflector 300. At least some of this light may be reflected by the reflective surface 310 of the enclosure 302. Some of the light generated by the LED assembly 130 may also be projected directly out of the exit surface 308 without being reflected by the primary reflector 300 or the reflective surface 310. The reflective surface 310 is shaped to provide the desired light pattern such that light is reflected from surface 310 and emitted from the lamp at a desired beam angle. In a BR-style lamp where the beam angle may not be tightly controlled the surface 310 may have any suitable shape. In a PAR style bulb the reflective surface 300*a* of the reflector 300 may be formed as a parabola to create a narrower beam. Moreover, the reflective surface 310 of the enclosure 302 may be shaped such as a parabolic reflector to obtain the desired narrow beam.

While the reflective surface 300*a* is shown as being arranged closely adjacent to the LED assembly 300, the reflector may be arranged such that the reflective surface is spaced from the LED assembly and covers a larger portion of, or the entire, reflective surface 310, of the enclosure 302 where the reflective surface 300*a* reflects a larger percentage, or all, of the light emitted by the LEDs 127.

As previously described, in order overcome issues relating to the exposure of live electrical components in the event of enclosure failure, the problems associated with localized phosphors on the LEDs and/or the expense of treating or manufacturing the enclosure 112 with light modifying technologies, an optical interface 200 is provided internally of the enclosure that surrounds the LED assembly or portions of the LED assembly to isolate the LED assembly and/or to optically modify the light emitted by the LEDs. The optical interface may be arranged to closely surround the LED assembly and may surround the reflector 300 or a portion of the reflector. The optical interface may comprise light modifying properties that modify a characteristic of the light emitted by LED as assembly 130.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an at least partially optically transmissive glass enclosure;

a base defining a longitudinal axis of the lamp extending from the base to the at least partially optically transmissive glass enclosure;

a heat sink extending into the at least partially transmissive glass enclosure substantially along the longitudinal axis;

at least one LED mounted on a submount, the submount being mounted on the heat sink in the at least partially optically transmissive glass enclosure, and the at least one LED operable to emit light when energized through an electrical path from the base to the submount, the electrical path comprises a lamp electronics board and a deformable electrical contact on one of the submount and the lamp electronics board that is biased into engagement with an electrical contact on the other one of the submount and the lamp electronics board to create a live contact coupling in the enclosure, the submount being generally cylindrically shaped and extending along the longitudinal axis;

an optical interface disposed between the at least one LED and the at least partially optically transmissive glass enclosure, the optical interface being generally cylindrically shaped and open at at least one end thereof and being suspended on the heat sink and disposed outside of the submount such that light from the at least one LED passes through the optical interface, said optical interface being electrically insulating and configured to electrically isolate at least the live contact coupling and comprising a light modifying property such that a characteristic of the light may be modified as the light passes through the optical interface, wherein a passage is provided allowing a gas to circulate between the at least one LED and the enclosure, the passage being configured such that a probe simulating a human finger cannot contact the live contact coupling through the passage.

2. The lamp of claim 1 wherein the characteristic of the light comprises a color of the light.

3. The lamp of claim 1 wherein the optical interface comprises a phosphor.

4. The lamp of claim 1 wherein the light modifying property is caused by a material comprising a rare earth element (REE).

5. The lamp of claim 4 wherein the REE comprises neodymium.

6. The lamp of claim 1 wherein light comprises a second characteristic and the optical interface comprises a second light modifying property where the optical interface modifies the first and second characteristics.

7. The lamp of claim 1 wherein light passing through the optical interface is filtered so that the light exiting the optical element exhibits a spectral notch.

8. The lamp of claim 7 wherein the spectral notch occurs between the wavelengths of 520 nm and 605 nm.

9. The lamp of claim 1 wherein the base comprises an Edison screw.

10. The lamp of claim 1 wherein the optical interface comprises an elastic material.

11. The lamp of claim 1 wherein the optical interface comprises silicone.

12. A lamp comprising:

an at least partially optically transmissive glass enclosure;

a base connected to the enclosure;

a heat sink extending into the at least partially optically transmissive glass enclosure;

a plurality of LEDs located in the at least partially optically transmissive glass enclosure and operable to emit light when energized through an electrical path from the base, the plurality of LEDs being mounted on a submount where the submount is in the electrical path; wherein the electrical path comprises a lamp electronics board and a deformable electrical contact on one of the submount and the lamp electronics board that is biased into engagement with an electrical contact on the other one of the submount and the lamp electronics board to create a live contact coupling in the enclosure;

an optical interface positioned in the at least partially optically transmissive glass enclosure and spaced from the submount for electrically isolating a live electrical component from the exterior via breaks in the at least partially optically transmissive glass enclosure of the lamp in the event that the at least partially optically transmissive glass enclosure breaks and for receiving at least a portion of the light, the optical interface comprising a glass enclosure having a shatter resistant coating and comprising a light modifying property for modifying a characteristic of the portion of the light, the optical interface being generally cylindrically shaped and open at least one at end thereof and being suspended on the heat sink and disposed outside of the submount such that light from the at least one LED passes through the optical interface, said optical interface being electrically insulating, and wherein a passage is provided allowing a gas to circulate between the at least one LED and the enclosure, the passage being configured such that a probe simulating a human finger cannot contact the live contact coupling through the passage.

13. The lamp of claim 12 wherein the characteristic of the light comprises a color of the light.

14. The lamp of claim 12 wherein the optical interface comprises a phosphor.

15. The lamp of claim 12 wherein the optical interface comprises a rare earth element (REE).

16. The lamp of claim 12 wherein light comprises a second characteristic and the optical interface comprises a second light modifying property where the optical interface modifies the first and second characteristics.

17. The lamp of claim 12 wherein the base comprises an Edison screw.

* * * * *